US008672031B2

(12) United States Patent
Vaynshteyn

(10) Patent No.: US 8,672,031 B2
(45) Date of Patent: Mar. 18, 2014

(54) PERFORATING WITH WIRED DRILL PIPE

(75) Inventor: Vladimir Vaynshteyn, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 587 days.

(21) Appl. No.: 12/724,187

(22) Filed: Mar. 15, 2010

(65) Prior Publication Data

US 2010/0230105 A1 Sep. 16, 2010

Related U.S. Application Data

(60) Provisional application No. 61/160,114, filed on Mar. 13, 2009.

(51) Int. Cl.
*E21B 43/11* (2006.01)

(52) U.S. Cl.
USPC ..... 166/297; 166/55; 166/63; 166/65.1; 175/4.51

(58) Field of Classification Search
USPC ..... 166/55, 55.1, 297, 63, 65.1; 175/4.51, 175/5.52, 4.55
See application file for complete search history.

(56) References Cited

U.S. PATENT DOCUMENTS

| | | | | |
|---|---|---|---|---|
| 5,908,365 | A * | 6/1999 | LaJaunie et al. | 175/4.56 |
| 6,641,434 | B2 * | 11/2003 | Boyle et al. | 439/577 |
| 6,759,968 | B2 * | 7/2004 | Zierolf | 340/854.8 |
| 6,837,310 | B2 * | 1/2005 | Martin | 166/297 |
| 8,031,081 | B2 | 10/2011 | Pisoni et al. | |
| 2002/0007949 | A1 * | 1/2002 | Tolman et al. | 166/280 |
| 2007/0193740 | A1 * | 8/2007 | Quint | 166/250.07 |

* cited by examiner

*Primary Examiner* — Giovanna Wright
*Assistant Examiner* — Taras P Bemko
(74) *Attorney, Agent, or Firm* — Kimberly Ballew

(57) ABSTRACT

Embodiments of the invention include methods and systems for perforating a well using a wired work string assembly. According to embodiments of the invention, the method includes positioning a wired work string assembly in a wellbore, the work string assembly comprising a plurality of wired pipe communicatively coupled at each joint, a depth correlation tool, and a perforating gun assembly. A depth of the perforating gun assembly is determined from a depth correlation tool positioned within the wellbore, and an electrical signal related to the depth of the perforating gun assembly is transmitted to a surface above the wellbore. Firing of the perforating gun assembly is initiated via a signal transmitted from the surface above the wellbore. An electrical signal from the wellbore is transmitted to the surface to confirming the firing of perforating gun assembly. The system includes various tools for perforating the well using the disclosed methods.

19 Claims, 5 Drawing Sheets

PERFORATING WITH WIRED DRILL PIPE

CROSS-REFERENCE TO RELATED APPLICATION

This application claims benefit of U.S. Provisional Patent Application Ser. No. 61/160,114, filed Mar. 13, 2009, which is herein incorporated by reference in its entirety.

BACKGROUND OF THE INVENTION

Perforation refers to a hole punched in the casing or liner of an oil well to connect a wellbore to a reservoir. In cased hole completions, the wellbore is drilled either at or past a section of the formation desired for production. Casing or a liner is used to separate the formation from the wellbore that is often cemented into the producing reservoir. The final stage of the completion process involves running in perforating gun assemblies down to the desired depth and/or orientation and firing them to perforate the casing, liner, cement, and/or the producing formation. Perforating gun assemblies may use steel bullets or shaped explosive charges, which, when detonated, produce extremely fast jets of gasses that blow the perforations into the casing, cement, and producing formation. A typical perforating gun assembly can carry many dozens of charges and may include a string of shaped charges.

Today, perforating gun assemblies can be conveyed on wireline, slickline, coil tubing or tubing (production tubing, drill pipe, etc). The perforating service methods, features and capabilities depend on the type of conveyance. For example, wireline perforating allows an accurate real-time depth correlation by running gamma ray ("GR") and casing collar locator ("CCL") measurement tools with the perforating gun assemblies along with surface to downhole telemetry via wireline cable. Wireline perforating can use a fast and simple gun initiation via wireline cable, to initiate the perforating gun assembly. However, wireline cable strength (or tensile) rating limits the length and number of perforating gun assemblies. In addition, wireline deployment in highly deviated or horizontal wells requires the use of downhole tractor or pumping down technique that may still be limited in terms of gun length/weight or require multiple trips in the hole. Typically wireline guns are used for overbalanced or balanced perforating (i.e. pressure in the well is equal or higher than formation pressure), as underbalance perforating typically induces well to flow and poses a risk of guns and the cable being blown uphole or requires an anchoring mechanism to keep them in place.

Slickline is wireline having a high strength to weight ratio. However, no communication with the surface is possible with slickline. Instead, a special firing head is used that senses a timed up/down motion of the slick line that constitutes a unique firing command to initiate the guns. Alternatively, other firing head designs may use a mechanism on the gun that arms the charges upon reaching a certain temperature and pressure. A timer will then fire the perforation assembly following a set interval. The depth correlation for Slickline perforation is typically done via separate run with GR/CCL tool in memory mode and marking Slickline reference point at surface for applying depth offset determined from the GR/CCL log. The main advantage of the Slickline is low cost and small footprint of the Slickline unit thus simplifying deployment logistics, for example on the small production platform. In all other ways like tensile rating and control/feedback of perforating events it is inferior to Wireline and TCP perforating.

New wireline and TCP perforating techniques with dynamic underbalance (PURE system) have been introduced to facilitate removing the explosion debris from the perforating tunnel, thus improving the well producability (reducing skin effects). However, all other limitations of the wireline and TCP deployments described above still remain.

In cases where a long gun string is too heavy for wireline cable, or when flowing the well immediately after the perforation to put the well on production (in the case of permanent completion), or to test or clean up the producing interval after perforating, the guns are run on the tubing. This is the essence of tubing conveyed perforating ("TCP"). Highly deviated and horizontal wells may also require the use of TCP to gain access to the desired perforating depth. If flowing the well is required after the perforation, it typically is accomplished by establishing the pressure in the tubing interior diameter (hereinafter "ID") lower than formation pressure before the perforating. Known methods for accomplishing this include placing low weight fluid or gas in the tubing ID and sealing it off from the well's annulus with a packer. Often, flow (test) valves and circulating (tubing ID-OD) valves are run with the string to facilitate well flow and safety control, placement of fluid cushions, circulating out well effluent, etc.

TCP techniques enable perforating very long intervals in one run. For example, some TCP strings have exceeded 8,000 ft in length. TCP also facilitates running large guns and using high underbalance. Without having to kill the well, TCP strings can be retrieved (shoot and pull) or left as part of the permanent completion (integrated TCP).

Typically, to initiate the TCP guns hydraulic/mechanical tools and percussion detonators are used, triggered by applying additional pressure to the well or dropping the bar from the surface, etc. A new technology, eFire firing head, was introduced in the last decade. The eFire is a battery powered microprocessor controlled tool with an electrical initiator that can be triggered by lower level signals (typically pressure). Additionally, the initiation energy to set off the eFire detonator is provided by an on-board battery. While the eFire offers more flexibility and efficiency to many TCP operations, all TCP initiation methods are inferior to WL perforating that is done via simple entering of the perforating instructions in the surface computer. Moreover, TCP operations typically require a separate GR/CCL run on WL for depth correlation and proper placement of the perforating gun assemblies in the producing interval before initiation.

Another disadvantage of the TCP is a lack of data from downhole tools confirming the perforating operation or providing any downhole measurements before the string is pulled out of the hole. Typically, TCP operations utilize redundant firing heads or methods, but if the well does not flow to the surface it is often hard to confirm whether the guns were fired or the well did not produce as expected. Beyond the confirmation that the job objectives were met, retrieving unspent and potentially armed gun string from the well is a huge risk and an improved system and method is needed.

Thus, tubing conveyed methods and tools are difficult to control as there is no real time communication, no electrical signals, and operation is usually performed via simple pressure levels or timed pressure pulse instructions or by pure mechanical means (e.g. drop bar). For accurate depth placement, tubing methods typically require wireline run in conjunction with deployment of tubing conveyed perforating guns, which are often done in separate runs, increasing time and cost to perforate a casing. Wireline methods and tools for perforation also have limited applications. For example, wireline cannot employ a large number or great length of perforating gun assemblies because of the heavy weight of the gun.

Wireline is also usually limited to short intervals and not too deviated wells. Therefore there is a need for improved methods and systems for perforating a wellbore casing.

DETAILED DESCRIPTION

Figure 1:
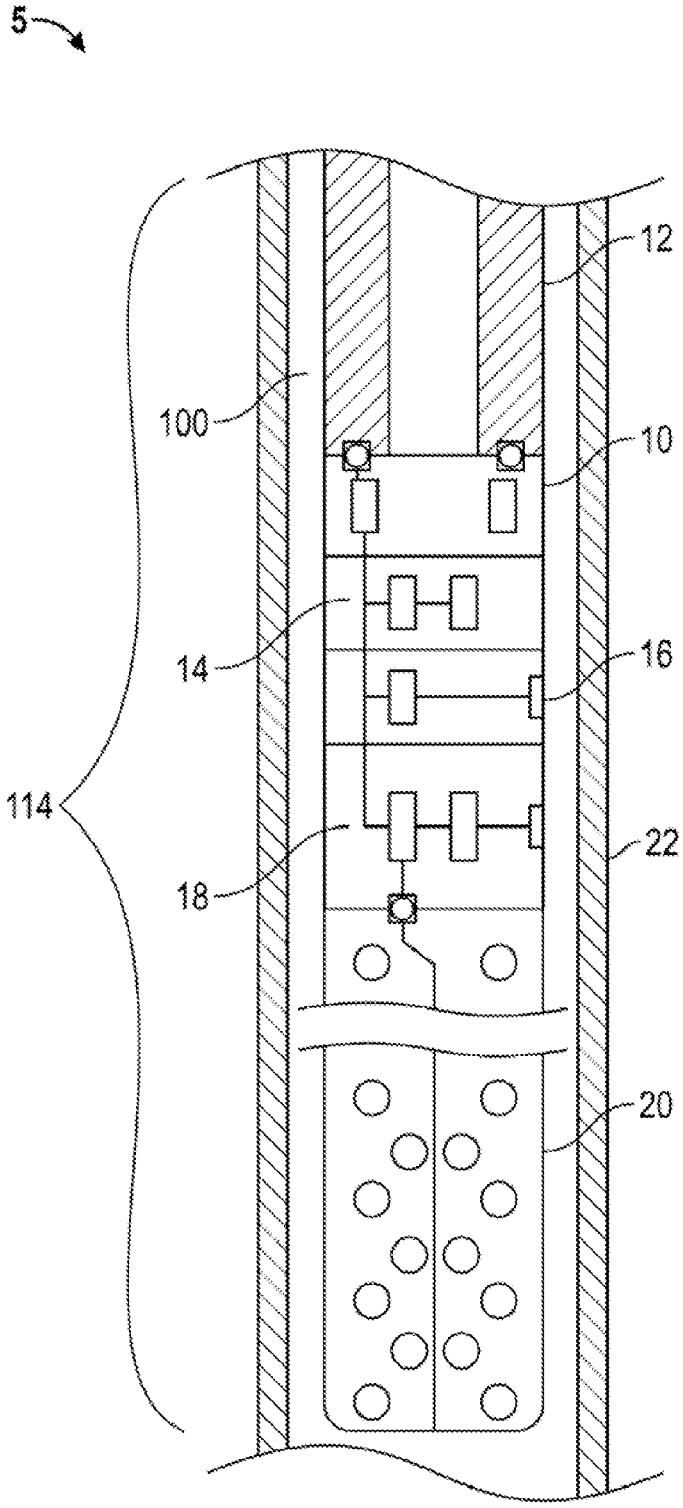
FIG. 1 illustrates an embodiment of a perforating system that may be used in overbalanced wellbores.

Embodiments of the present invention generally provide improved methods and systems for perforating a wellbore casing. The present invention may be used with any type of telemetry system, such as, mud pulse, acoustic telemetry, electromagnetic, hard wired pipe connections, but is preferably used with wired drill pipe telemetry. In addition, the telemetry system may include any combination of telemetry in series or in parallel, such as wired drill pipe and mud pulse. With wired pipe ("WDP") telemetry systems, the drill pipes that form the work string are provided with electronics capable of passing a signal bi-directionally between a surface unit and the downhole tool. As shown, for example, in U.S. Pat. No. 6,641,434, such wired pipe telemetry systems can be provided with wires and inductive couplings that form a communication chain that extends through a work string 114, as shown in FIG. 1. The wired pipe may be operatively connected to the downhole tool and a surface unit for bi-directional communication therewith. The wired pipe system is adapted to pass data received from components in the downhole tool to the surface unit and commands, data, and signals generated by the surface unit to the downhole tool.

Fluids between the interior of the work string and the annulus or from the reservoir to the interior of the work string may flow into before or after the perforating to accomplish various purposes, such as to facilitate underbalance perforating, clean up of the producing interval, or well test, etc. Tools may be positioned above the bottom hole assembly, for example, packers, tubing (flow) and ID-OD (circulating) valves, pressure recorders, and other tools typically run for such operations. In an embodiment, the tools may he either modified to be "wired" for surface control via wired drill pipe, communicate to the WDP via "short hop" downhole telemetry e.g., electromagnetic (EM) or acoustic), or otherwise adapted to communicate with wired pipe, which may comprise part or all of the work string, for TCP operations.

A command, which may be in the form of an electrical signal, may be received by the downhole tool to initiate firing of the perforating gun. For example, the command and/or data may be transmitted from the surface to the downhole tool. Alternatively, the command and/or data may be transmitted from a tool, sensor or other component downhole. Upon receiving and confirming the valid fire command, the downhole tool may apply the energy from the downhole energy source to the detonator to fire the guns. The downhole energy source can be electrical (battery) or non-electrical (e.g., hydraulic, mechanical, etc.). The downhole tool may have safety features to ensure that the energy is applied to the detonator only in response to the valid firing command. An example of such a tool is eFire firing head, which also may be adapted to receive surface commands in the form of electric signals.

Depending on wellbore considerations, tool considerations, and other considerations, the bottom hole assembly may be modified or changed as required for overbalanced, balanced, or underbalanced perforation. In an overbalanced well, there is usually no well flow expected. As a result, well control tools, such as packers, and flow and circulating valves, may not be required. FIG. 1 illustrates an embodiment of a system 5 for perforating casing 22 that may be used in an overbalanced well. A work string 114 is deployed into a wellbore 100. The work string 114 may comprise a portion of wired pipe 12 and a perforating assembly. In an overbalanced wellbore, the perforating assembly may comprise the following:

- A wired pipe interface sub 10, which may provide a telemetry interface between bottom hole assembly ("BHA") tools and a wired pipe 12;
- GR/CCL tools 14, which measure GR and CCL signals downhole and transmits them to the surface via wired drill pipe. In an embodiment, the signals may be digitized or processed prior to transmission to the surface, Transmission can be real time (RT) or post-real time (e.g., memory dump while BHA is downhole). GR/CCL logs may be used at the surface for depth correlation and proper gun placement in the producing interval before perforating.
- A recorder 16, which may be a fast pressure recorder. For example, the recorder 16 may measure well pressure, such as the well pressure immediately following the perforating event by, for example, using very high scan or sampling rates. Control signals may be received by the recorder 16 to begin measuring well pressure and/or may by synched to begin measuring before perforation initiation, such as immediately before perforation initiation, or after perforation initiation. The recorder 16 may be used with other wellbores, such as underbalanced wellbores or specifically the PURE dynamic underbalanced perforating system. Advantageously, the recorder 16 may be used in combination with an eFire system 18, and the recorder 16 may transmit measurements or other information to the surface via the wired pipe 12. Very fast sampling rates of conventional recorder systems typically do not allow sending real-time pressure data to the surface. However, use of the wired pipe 12 overcomes this deficiency, in an embodiment, the wired pipe 12 in combination with the recorder 16 may permit viewing the pressure events to confirm the operation of a perforating gun 20.
- An eFire system 18, which may comprise an eFiring head. The primary means of initiating &Fire may be an electric signal transmitted via the wired pipe 12. However, the eFire system 18 may be triggered with pressure pulses as well. The eFire system 18 may be used as a redundancy with respect to the signal transmitted via the wired pipe 12. If ballistic redundancy is desired, two eFire systems 18 may be packaged together and actuated via wired drill pipe or combination of wired drill pipe and pressure inputs. The eFire system 18 may transmit signals, data and/or information related to diagnostics, confirmations, and tool errors to the surface via the wired pipe 12. However, conventional perforation systems can not transmit ballistic confirmations to the surface. The eFire system 18 may be configured to run a SAFE detonator and an initiator circuit below the perforating gun 20. In such a configuration, the perforating gun 20 may be wired to communicate to the SAFE initiator and thus may allow ballistic confirmation (the impedance of the wire may change due to detonation). Such a configuration will also allow using the eFire system 18 for selective perforation, by running multiple SAFE initiator circuits, such as below each perforating gun 20.

Perforating guns 20, which may be any type of perforating guns known to those having ordinary skill in the art, including conventional or PURE type perforating guns. PURE perforating guns allow establishing dynamic underbalance in the well as the guns are set off, to facilitate removal of debris in the perforating tunnel.

Various embodiments of the invention may also include underbalanced perforating, which, indeed, is one of the advantages of the invention: a greater ability to perform underbalanced operations. Underbalanced perforating typically requires establishing a lower pressure in the well compared to formation pressure, and running tools in the well to facilitate well flow and control well safety. Various tools may be used for facilitating well flow or safety control including, but not limited to, packers (including retrievable packers), flow (test) valves, and circulating valves. Back-up valves may be run at times to provide operational redundancy. Jars are also sometimes run above the perforating guns and packers in case the work string becomes wedged or stuck during underbalanced perforating.

Figure 2:
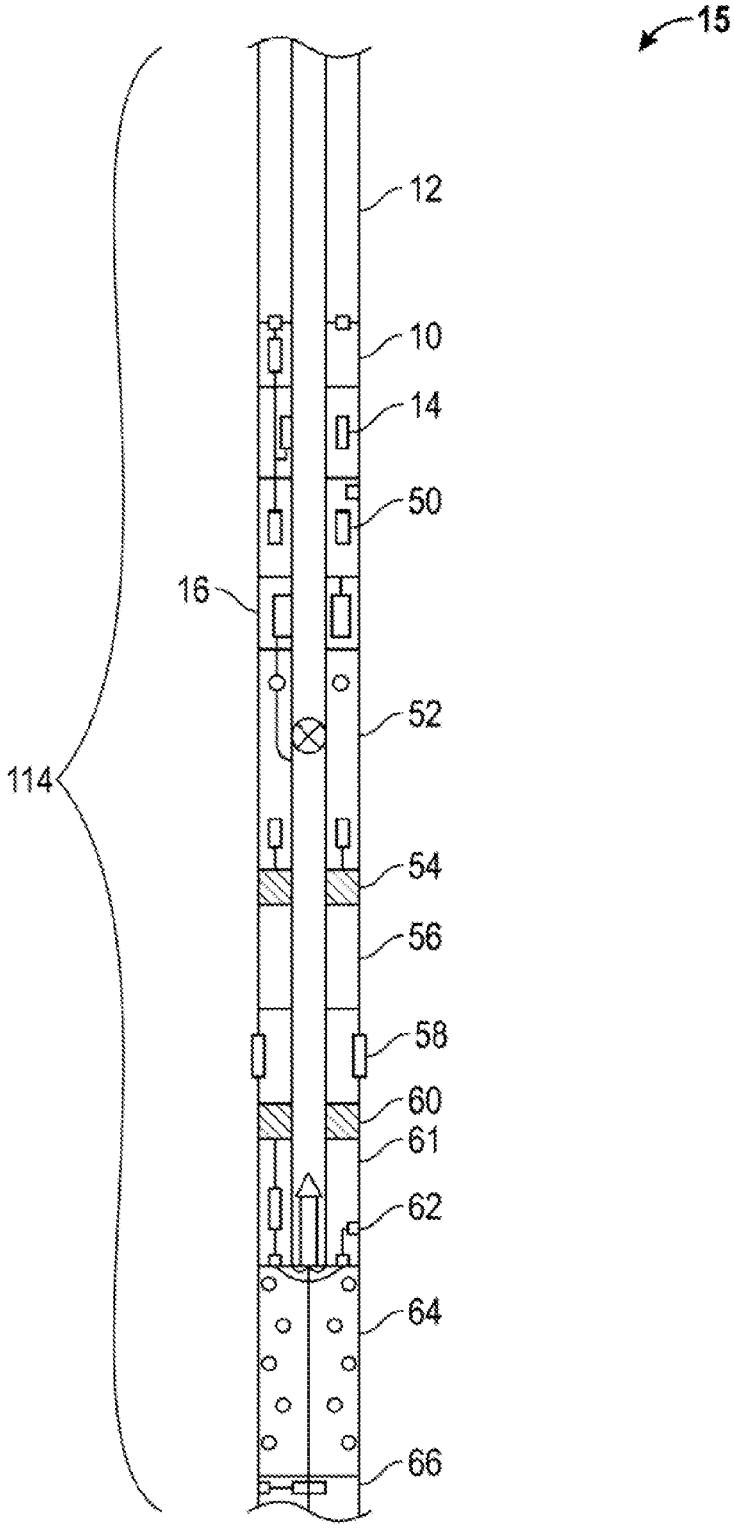
FIG. 2 illustrates an embodiment of a perforating system that may be used in underbalanced wellbores.

The BHA architecture may be dependent on the type or number of packers used. FIG. 2 illustrates an example of a perforating system 15 that may be used in a wellbore, such as an underbalanced wellbore. Preferably, each tool in the work string is wired to enable communication. However, wiring complex mechanical tools, such as packers and downhole valves is a difficult undertaking. To overcome this difficulty, the work string illustrated in FIG. 2 includes downhole wireless telemetry modules (EM, acoustic, or other types) to provide communication means between key tools in the string and the wired drill pipe interface 10. U.S. patent application Ser. No. 11/769,098, entitled "Wireless Telemetry Between Wellbore Tools" discloses methods for communicating across non-wired sections of a work string, specifically between tools, and is hereby incorporated by reference in its entirety.

The wired pipe interface sub 10 provides a telemetry interface between BHA tools and the wired pipe 12, which as mentioned above may have a portion of wired pipe (hereinafter the wired pipe 12 comprising a portion of wired pipe will be referred to as "wired pipe 12" for simplicity purposes). The BHA and WDP telemetry protocols may or may not be the same. GR/CCL tools 14 may be positioned in the tool string as shown in FIG. 2. For example, the GR/CCL tools 14 may be positioned adjacent to the wired drill pipe interface 10. The GR/CCL tools 14 may transmit signals related to measurements to the surface or a tool downhole. For example, in an embodiment, the GR/CCL tools 14 may digitize and/or process signals related to measurements and transmit the signals to the surface via the wired pipe 12. GR/CCL logs may be used at surface for depth correlation and proper gun placement in the producing interval of the surrounding reservoir before perforating.

A wired pipe—downhole ("WDP-DH") telemetry interface 50 may be positioned in the tool string and may have a diameter substantially similar to a diameter of the drill pipe, such as the wired drill pipe. The WDP-DH telemetry interface 50 may provide communication between tools or components downhole (closer to the end of the BHA) to the wired drill pipe interface 10 and ultimately to the surface. Alternatively, the WDP-DH telemetry interface 50 may communicate directly with the surface. The WDP-DH telemetry interface 50 enables communication between wired pipe 12, wired drill pipe-enabled modules, and downhole telemetry modules (DTM) located below non-wired tools in the bottom hole assembly.

A recorder 16, such as a pressure recorder, for example a Datalatch or similar recorder, may be positioned in the tool string. The recorder 16 may have a diameter substantially similar to a diameter of the drill pipe, such as the wired drill pipe. The recorder 16 may be positioned above the well flow (test) valve, and can measure pressure in the tubing above and below the valve, as well as annulus pressure and well temperature. Positioning the recorder 16 below the WDP-DH wireless telemetry interface 50 may facilitate direct electrical connection to the recorder 16 for telemetry and/or power.

One or more valves 52 may be positioned in the tool string. For example, the valves 52 may be positioned adjacent the recorder 16. The valves 52 may be control valves, such as intelligent remote dual valves ("IRDV") having a diameter substantially similar to the drill pipe, such as the wired drill pipe. IRDV incorporates test and circulating valves into a single tool.

A downhole telemetry module 54 may be positioned in the tool string and may be a full bore downhole telemetry module. The telemetry module 54 may be adjacent to the valves 52 to facilitate direct electrical connection to the telemetry module 54 for telemetry and/or power. The telemetry module 54 may enable surface communication and/or control for the valves 52.

A jar 56 and a packer 58 may be positioned within the work string. The jar 56 and the packer 58 may have diameters substantially similar to the wellbore or casing. The packer 58 may be a weight set type and may be used to seal a portion of the wellbore. Other types of packers that may be used include retrievable packers. The jar 56 may be a hydraulic or mechanical jar and may be used to deliver an impact load to another component of the work string or wellbore. For example, in instances in which any portion of the perforating system 15 becomes stuck, the jar may fire to dislodge the perforating system 15.

Downhole telemetry module 60 and/or the telemetry module 54 enables communication between the tools, such as the tools below the packer 58 and within or above the BHA. eFire firing head 62 and another recorder 61 may be positioned in the tool string. The recorder 61 may be a fast pressure recorder. The eFire firing head 62 may be initiated via the wired pipe 12, such as by transmission of a signal from uphole or the surface. If redundancy is desired, the eFire firing head 62 may be initiated via the pressure pulses. Of course, those of ordinary skill in the art will appreciate that either pressure pulses or signals from the wired pipe 12 may be used to initiate the eFire firing head 62, or these may be used in combination. The signals transmitted via the wired pipe 12 may be transmitted to the eFire firing head 62 via the downhole telemetry module 60 and/or the downhole telemetry module 54. If ballistic redundancy is desired, two eFire firing heads 62 can be packaged together (WDP actuated or combination of WDP and pressure actuated).

Perforating guns 64 may be positioned on the work string. The perforating guns 64 may have explosive charges that detonate to pierce the casing. Last shot detection and downhole telemetry module 66 may be positioned on the work string adjacent to the perforating guns 64. The last shot detection and downhole telemetry module 66 may detect conditions related to the perforating guns 64, for example the initiation of the detonating cord at the bottom of the gun string for a ballistic confirmation of the entire gun string. The downhole telemetry module 54 may relay the information to the surface via the WDP-Downhole Telemetry Interface 50.

Another alternative to perform an underbalanced perforating job is by utilizing a production packer for well control. A production packer is typically run on wireline or pipe on a separate run. When run on wireline, the bottom hole assembly may include a GR/CCL assembly for accurate placement of the packer at the desired depth. The packer typically includes a seal bore into which a seal stack run on the work string is landed, thus providing a seal between the annulus and the well fluids below the packer. The packer may also utilize a sting through flapper (or other) valve assembly 90 for isolating the well below and above the packer when the work string is retrieved. The work string may tag off or land on the packer for an accurate depth placement or utilize independent devices and/or methods for depth correlation (GR/CCL, radioactive tags, etc.).

Figure 3:
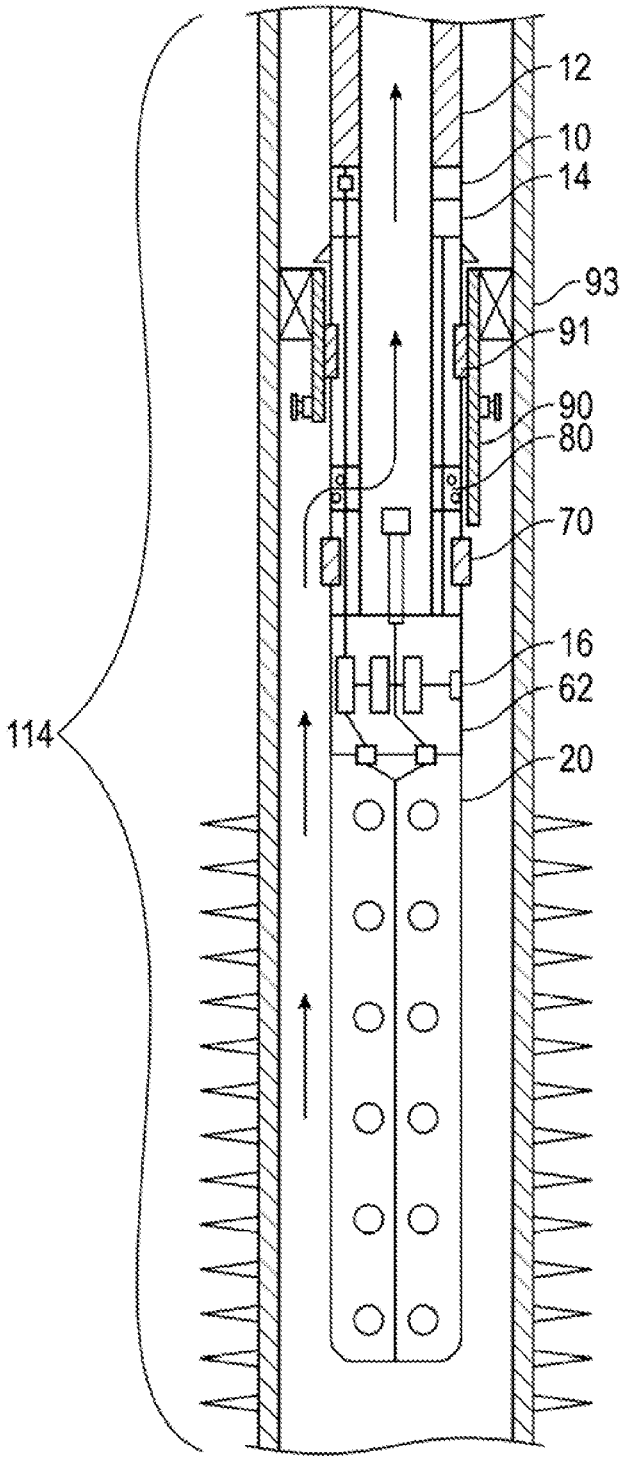
FIG. 3 illustrates another embodiment of a perforating system that may be used in underbalanced wellbores.

For sophisticated well control with the work string landed in the packer and stationary, work string BHA will utilize well control valves (flow and circulating) similar to the BHA presented above for underbalanced perforating with work string packer (e.g., IRDV or similar). In that case, to provide the communication between the surface and the part of BHA below non-wired tools, the wireless downhole telemetry (EM, acoustic, or other) and WDP interface modules will need to be used. However, it may be possible to provide a direct electric communication from the WDP Interface all the way to the Firing Head assembly and simplified well control by utilizing a wired through seal assembly and ported sub as illustrated in FIG. 3. In this case, the functionalities of the key work string BHA modules are as follows: the WDP Interface sub 10, the GR/CCL tools 14, wired seal stack assembly 91, wired ported sub 80, another wired seal stack assembly 70, an eFire firing head 62, recorder 16, and perforating guns 20.

The work string may include a seal stack assembly 91 that isolates the well annulus from the fluids below a production packer 93 when the seal stack assembly 91 is positioned in the packer seal bore. The seal stack assembly 91 may be wired and in communication with the wired pipe 12. A ported sub 80 may be wired and provide a flow path from the producing interval to the internal diameter of the wired pipe 12 when the seal stack assembly 91 is positioned in the packer seal bore. The ported sub 80 may enable circulation between the interior diameter of the wired pipe 12 and the annulus above the packer 93 when the string is picked up to position a seal stack assembly 70 in the packer seal bore. The seal stack assembly 70 may be wired and may be used to isolate the producing interval and the volume below the seal stack 70 from the fluids above the seal stack (well annulus and the tubing ID) when the seal stack assembly 70 is positioned in the packer seal bore.

Initiating eFire may be via a signal transmitted to the eFire firing head 62 via the wired Interface sub 10 and wired through the seal stack assembly 91, the ported sub 80 and the seal stack assembly 70. If redundancy is desired, it can also be initiated via the pressure pulses. If ballistic redundancy is desired, two eFires can be packaged together (WDP actuated or combination of WDP and pressure actuated).

In light of the above embodiments described, the system for perforating a wellbore casing may include a work string assembly having an inner diameter, where the work string assembly includes a plurality of wired drill. pipe (WDP) 12 and a depth correlation tool located along, the work string assembly and electrically coupled to the WDP. The depth correlation tool may include the GR/CCL measurement tools 14. The system also includes one or more perforating gun assemblies 20, 64 located along the work string assembly and electrically coupled to the WDP 12. A flow control device located along the work string, assembly controls flow of fluid from a reservoir surrounding the wellbore into the work string assembly inner diameter. The flow control device may be valves 52 electrically coupled to the WDP and controllable from a surface above the wellbore via, signals transmitted through the wired drill pipe, a wired through ported sub 80, or two wired through seal stack assemblies 91 and 70 that can control the flow from the producing interval into the ID of WDP or from ID of the WDP to the well bore annulus by picking up or lowering the string to place one or another seal stack into the packer's seal bore.

Figure 4:
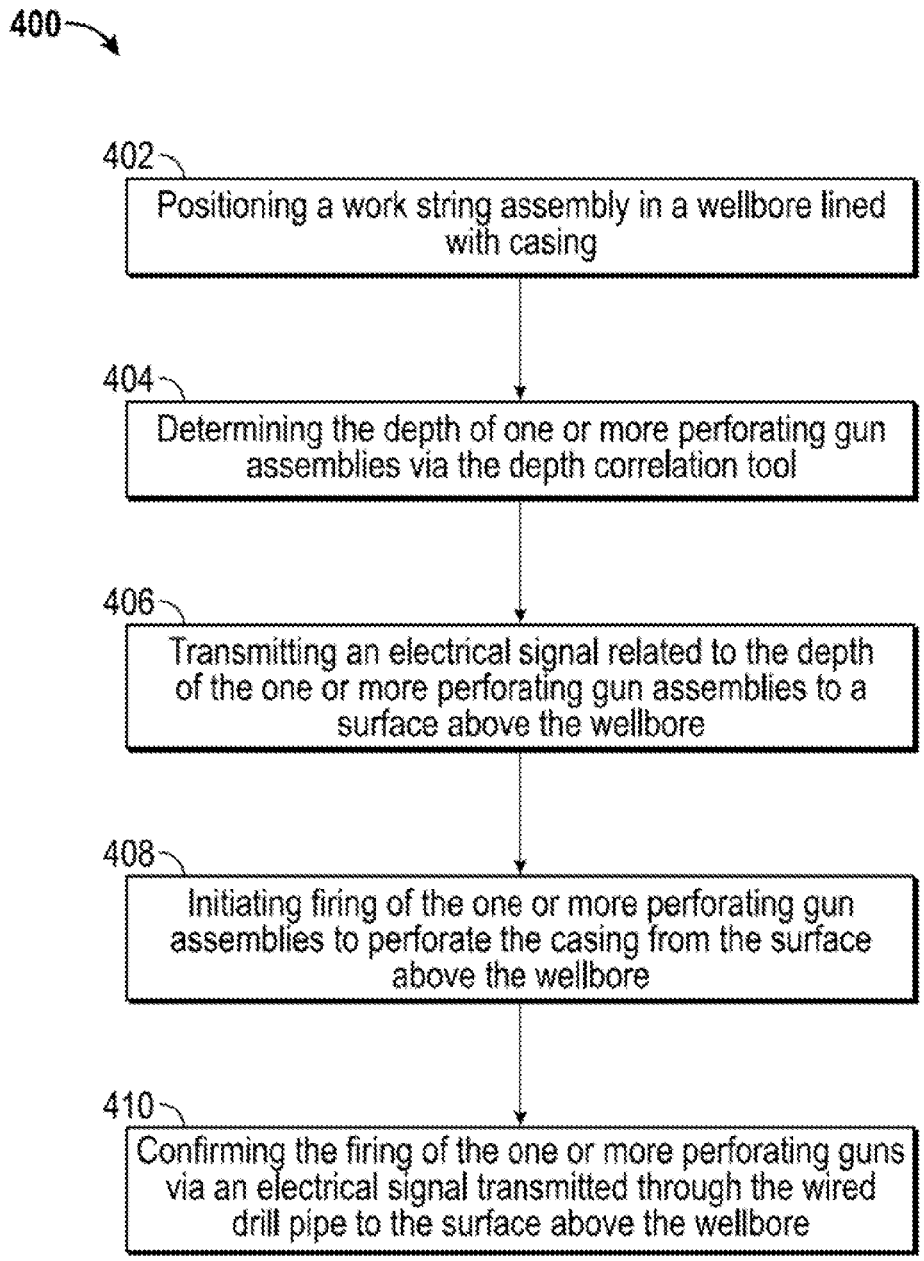
FIG. 4 illustrates a method of perforating a wellbore casing according to another embodiment of the invention.

FIG. 4 illustrates another embodiment of the invention: a method 400 for perforating a wellbore casing. The method 400 includes positioning a work string assembly in a wellbore lined with casing, as shown in box 402. The work string assembly includes a plurality of wired drill pipe (WDP) communicatively coupled at each joint, a depth correlation tool, and one or more perforating gun assemblies, such as shown in FIGS. 1-3. The perforating gun assemblies 20 may include a plurality of shaped charges, a primer cord, a detonator, and a gun carrier or housing, and other conventional components typically used for well perforations and known by those of ordinary skill in the art.

The method 400 further includes determining the depth of the one or more perforating gun assemblies via the depth correlation tool, as shown in box 404, and transmitting an electrical signal related to the depth of the one or more perforating gun assemblies to a surface above the wellbore, as shown in box 406. A processor located above the surface of the wellbore is in communication with the WDP and can send and receive various signals, power, data, commands, etc. that are transmitted along the WDP. In some embodiments, the processor automatically transmits firing signals, confirmation of firing signals, depth location signal inquiries, depth confirmation signals, etc. depending on how the processor is programmed to oversee communication with various downhole tools along the work string and the surface above the wellbore.

Determining the depth of the perforating gun assemblies may be executed in various ways. For example, in one embodiment, determining the depth may include measuring gamma ray radiation of the wellbore with a depth correlation tool, such as a GR measurement tool described above, as it is lowered into the wellbore with the work string assembly. The GR measurement tool transmits the collected radiation data (measured gamma ray) to the surface above the wellbore through the WDP. This transmission may occur on a continuous basis as the work string assembly is lowered into the wellbore. The collected gamma ray radiation data is then compared to the reference gamma ray vs depth log of the wellbore to determine the position of the depth correlation tool within the wellbore and confirming the position of the gun assembly relative to the formation interval that needs to be perforated and produced.

In another embodiment, determining the depth of the perforating gun assemblies may include measuring a magnetic anomaly of a casing joint with the depth correlation tool, such as the CCL, as the work string assembly is lowered into the wellbore. During lining of a wellbore with casing, each casing joint constitutes a magnetic anomaly. As the CCL tool passes each casing joint, it detects the magnetic anomaly between joints and transmits the magnetic anomaly data through the WDP to the surface above the wellbore. The location of the collars can then be compared to a reference CCL/GR vs depth log for additional confirmation of the gun assembly position relative to the interval that needs to be perforated and produced. Based on the known position of the GR/CCL tools along the work string assembly in relation to the position of the perforating gun assemblies along the work string assembly, the depth of the perforating gun assemblies can be determined to enable more accurate placement of the perforating gun assemblies.

As previously discussed above, the measured data from the GR/CCL measurement tools can be sent continuously up the WDP to the surface above the wellbore in real time or can be recorded and then memory dumped (the recorded data is transmitted through the WDP to the surface) post-real time while the GR/CCL measurement tools are still in the wellbore. The position of the one or more perforating gun assemblies within the wellbore may be verified based on the position of the depth correlation tool within the wellbore and the location of the depth correlation tool along the work string assembly compared to the location of the on or more perforating gun assemblies along the work string assembly. The firing of the one or more perforating gun assemblies may be automatically initiated by a process located at the surface above the wellbore. The process or transmits a firing signal through the wired drill pipe to initiate the firing when a desired the perforating gun assemblies are located at a desired position within the wellbore.

The method 400 also includes initiating firing of the one or more perforating gun assemblies to perforate the casing from the surface above the wellbore, as shown in box 408. Use of the WDP enables push button firing initiation, something which is not available using conventional tubing conveyed methods to perforate casing. Initiating the firing of the perforating gun assemblies may be executed in various ways. In one embodiment, a firing command signal is transmitted from the surface above the wellbore through the WDP to one or more firing tools located in the BHA assembly and electrically coupled with the WDP. In another embodiment, the firing command signal and power necessary to initiate the detonation is transmitted directly to the one or more perforating gun assemblies without the use of any firing tools. Yet in another example, the battery powered firing tool can be used but with the levels of battery power insufficient to initiate the detonation. The firing command signal and additional power to make it sufficient for the detonation is sent via the WDP from the surface to fire the guns. Some examples of firing tools include, but are not limited to, eFire firing head as discussed previously.

Multiple firing tools may be placed along the work string assembly to form a redundancy. The one or more firing tools receive the firing command signal transmitted from the surface above the wellbore. The firing command signal may be confirmed by the firing tool to ensure a correct firing command was actually received. Once the firing command signal has been confirmed, energy from the firing tools is applied to a detonator of the one or more perforating gun assemblies to initiate firing of the one or more perforating gun assemblies. The energy may be mechanical/hydraulic or electrical, such as power from a battery stored on the firing tool as previously discussed.

Method 400 also includes confirming the firing of the one or more perforating gun assemblies via an electrical signal transmitted through the WDP to the surface above the wellbore, as shown in box 410. Confirmation of the perforating gun assemblies can prevent accidently lifting unfired charges to the surface above the wellbore, a situation that can be very dangerous to the people working at the surface above the wellbore should those undetonated charges explode after pulling the drill assembly to the surface. Various methods may be used to confirm the firing of the perforating gun assemblies.

In one embodiment, confirming the firing of the perforating gun assemblies may include measuring a first wellbore pressure with a tool located along the work string assembly before initiating the firing of the one or more perforating gun assemblies, transmitting the first wellbore pressure data from the tool through the WDP to the surface above the wellbore, measuring a second wellbore pressure with the firing confirmation tool after initiating the firing of the one or more perforating gun assemblies, transmitting the second wellbore pressure data from the firing confirmation tool through the WDP to the surface above the wellbore, and comparing the first wellbore pressure data with the second wellbore pressure data to confirm firing of the one or more perforating gun assemblies. In another embodiment, the wellbore pressure is continuously measured while the work string assembly is in the wellbore. A firing confirmation signal is automatically transmitted from the firing confirmation tool through the wired drill pipe to the surface above the wellbore after initiating the firing of the one or more perforating gun assemblies. The firing confirmation signal is transmitted after detecting a change in wellbore pressure corresponding to firing of the one or more perforating gun assemblies.

The tools may include, but are not limited to, a PURE system, an eFire firing head, or standalone pressure recorders. In a PURE system that is typically used for underbalanced perforating, a fast pressure gauge is placed right above the perforating gun assemblies or a firing tool. The Pure system includes pressure recorder that has the fast sampling capabilities. Initial pressures may be measured, recorded, and transmitted to the surface above the wellbore via the WDP. The fast sampling feature is then triggered by the firing of the gun assemblies, which recorded fast sampling data is then transmitted to the surface above the wellbore via the WDP. The eFire firing head tool begins recording the pressure of the wellbore upon receiving instructions to fire the perforating gun assemblies. A large pressure decrease may follow after the perforating guns fire, followed by a pressure increase as fluid from the surrounding reservoir begins to fill the wellbore. No pressure changes after firing may indicate that the perforating guns failed to fire.

A standalone pressure recorder may also by used in conjunction with the PURE system. Typically, the standalone pressure recorder samples pressure at a slow rate and then when it measures a change in pressure, it switches to a fast sampling rate. Confirmation of the firing of the perforating gun assemblies using pressure data will vary on the type of wellbore conditions and tools used. For example, an increase in wellbore pressure after initiating firing of the perforating guns may confirm that firing actually took place, whereas in other circumstances a decrease in wellbore pressure may indicate that firing of the perforating guns took place. Regardless of the actual tool used, the data is sent from the wellbore through the WDP to the surface above the wellbore in real time or post-real time while the work string is still in the wellbore.

Another embodiment of confirming the firing of the perforating gun assemblies may include closing electrical contacts to complete an electrical circuit in a firing confirmation tool located along the work string assembly and transmitting a firing confirmation signal from the firing confirmation tool through the WDP to the surface above the wellbore after the electrical contacts close, wherein the electrical contacts close after a portion of a primer cord of the one or more gun perforating assemblies located near the electrical contacts explodes. An example of this type of firing confirmation tool is a Last Shot Detection tool. Confirming the firing of the one or more perforating gun assemblies may also include transmitting an electrical signal from a shock measure device via the WDP to the surface above the wellbore.

In another embodiment, the method includes controlling fluid flow from a reservoir surrounding the wellbore into an inner diameter of the work string assembly via a flow control signal transmitted from the surface above the wellbore through the WDP to the flow control device. The flow of fluid from the surrounding reservoir into the inner diameter of the WDP may be controlled from the surface above the wellbore. Control signals may be sent along the WDP to control valves or ported subs to increase or decrease flow from the wellbore to the top surface.

Wired drill pipe allows commands, information and data in substantially real-time to he transmitted from downhole to the surface, and vice versa. The use of wired drill pipe for perforation may, for example, permit the transmission of commands, information or data related to a perforating event, such as a confirmation that a perforating step is complete, diagnostics of perforating guns or other perforating tools, and reporting information related to the performance of the perforating guns and other tools. The wired drill pipe may be used to control, diagnose, or report information for any one of the various tools along a work string assembly, including, but not limited to, pressure recorders, well control valves, packers (including retrievable packers), jars, slip joints, and firing tools.

Other non-limiting examples of information that may be transmitted and/or received to aid in the perforation process include: tool diagnostics data from the firing head, information related to monitoring a perforating event with the downhole sensors (e.g., pressure sensors, accelerometers, flow monitors, etc.), data from the recorder, such as a pressure recorder utilized with PURE perforating, and signals from Last Shot Detection, a device confirming detonating cord initiation along the entire gun string, etc.

Figure 5:
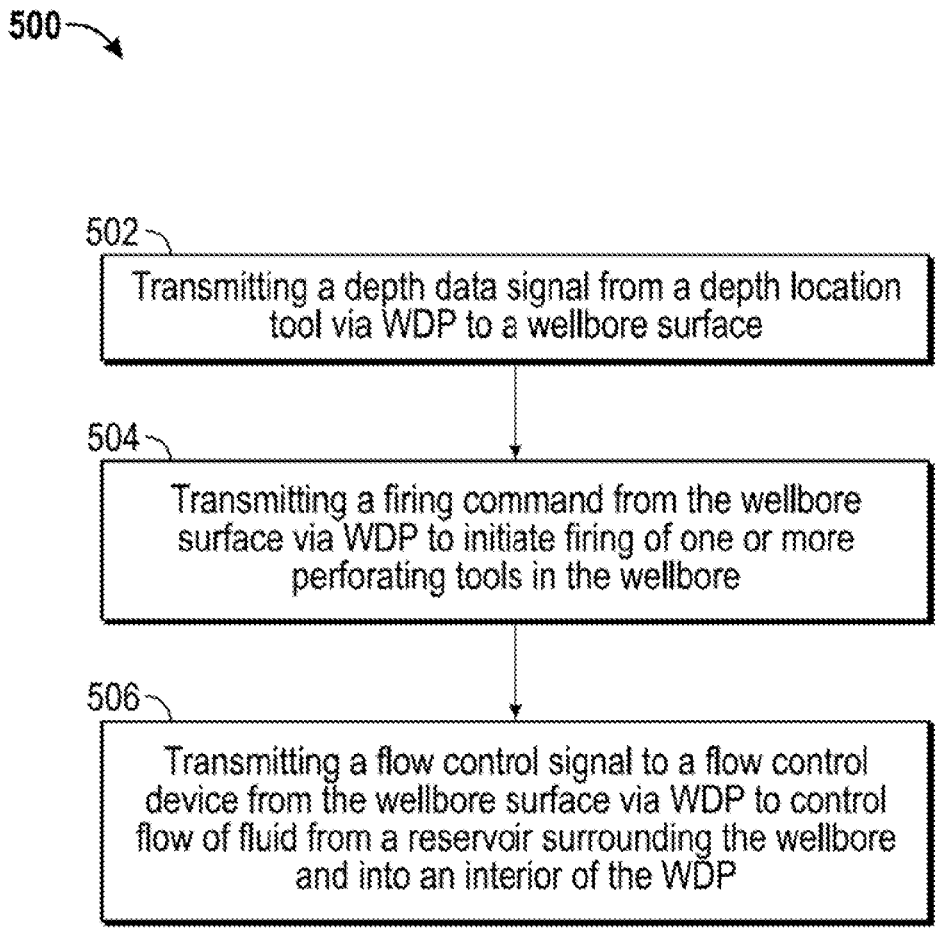
FIG. 5 illustrates another method or perforating a wellbore casing according to another embodiment of the invention.

FIG. 5 illustrates another embodiment of the invention: a method 500 for monitoring a perforation process of a wellbore casing. The method 500 includes transmitting a depth data signal from a depth correlation tool via wired drill pipe (WDP) to a surface above the wellbore, as shown in box 502. The depth correlation tool is below the surface above the wellbore and electrically coupled to the WDP. The depth data signal is used to position one or more perforating tools at a desired depth in the wellbore. The method 500 also includes transmitting a firing command from the surface above the wellbore via WDP to initiate firing of one or more perforating tools in the wellbore, as shown in box 504. The firing initiation is down after the perforating gun assemblies are positioned at the desired depth. The method 500 further includes transmitting a flow control signal to a flow control device from the surface above the wellbore via WDP to control flow of fluid from a reservoir surrounding the wellbore and into an internal diameter of the WDP, as shown in box 506.

The transmitted flow control signal can control fluid flow from a reservoir surrounding the wellbore into an interior of the work string by partially opening or closing the flow control device with the flow control signal. Additionally, fluid flow from an interior of the wired drill pipe to a wellbore annulus may also be controlled by signals from the surface above the wellbore by partially opening or closing one or more ported subs along the work string assembly. The work string may also be repositioned as necessary so that one or more wired through seal stack assemblies are placed on an inside seal bore of a permanent packer placed within the wellbore, as previously described.

Embodiments of the present invention may enable various improvements. For example, the depth of the perforating gun assemblies may be correlated in real time and eliminate or reduce depth errors, thus avoiding very costly and potentially catastrophic events of off-depth perforating. The perforating gun assemblies may be initiated by commands directly from the surface through the wired drill pipe and the instructions sent to initiate the firing may be confirmed and not confused with any other instructions. Additionally, real time or near real-time confirmation of perforating gun assembly firing, such as by pressure spike or sending a signal to verify gun firing, is possible.

Conveying perforating gun assemblies on wired drill pipe may have other various advantages. For example, wired drill pipe may provide the following features and capabilities:

- Longer gun strings for deployment in deviated/horizontal wells;
- Real time depth correlation utilizing GR/CCL measurement modules in the gun string and data transmission to the surface;
- Easy and fast gun initiation utilizing an electrical signal (commands) and power transmitted from the surface to the downhole tool via wired drill pipe;
- Downhole perforating event confirmation/diagnostics sent to surface via wired drill pipe;
- Flow gas and/or oil into the wired drill pipe after the perforating event;
- Firing guns in a desired sequence;
- Running with and controlling other tools in the hole, such as packers or testing tools; and
- Can easily perforate in underbalanced conditions.

The detailed description provides examples of embodiments of the present invention, but a person having ordinary skill in the art will appreciate that the present invention is not limited to these embodiments. For example, other embodiments and a combination of the described embodiments may be within the spirit of the invention and may readily be appreciated by a person of ordinary skill in the art. While the invention is described as being used to transmit data and information in a borehole, such as while drilling, the present invention may be applicable to any system for transmitting information. Thus, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for perforating a wellbore casing, comprising:

positioning a work string assembly in a wellbore, the work string assembly comprising a plurality of wired pipe communicatively coupled at each joint, a depth correlation tool, and a perforating gun assembly;

determining the depth of the perforating gun assembly via the depth correlation tool;

transmitting a first electrical signal along the work string assembly from the depth correlation tool to a surface above the wellbore, the first electrical signal related to the depth of the perforating gun assembly;

transmitting a second electrical signal along the work string assembly from the surface above the wellbore to the perforating gun assembly, the second electrical signal initiating firing of the perforating gun assembly; and transmitting a third electrical signal along the work string assembly to the surface above the wellbore, the third electrical signal related to a confirmation of the firing of the perforating gun assembly, wherein determining the depth comprises receiving depth data at the surface above the wellbore from the depth correlation tool via the work string assembly in real time or post-real time while the depth correlation tool is downhole.

2. The method of claim 1, wherein the step of transmitting the third electrical signal further comprises:

measuring a first wellbore pressure prior to initiation of the firing of the perforating gun assembly; transmitting a signal related to the first wellbore pressure along the work string assembly to the surface above the wellbore;

measuring a second wellbore pressure after the second electrical signal is or should have been received by the perforating gun assembly;

transmitting a signal related to a second wellbore pressure along the work string assembly to the surface above the wellbore; and generating the third electrical signal based on the first wellbore pressure and the second wellbore pressure.

3. The method of claim 1, wherein the step of transmitting the third electrical signal further comprises:

continuously measuring a wellbore pressure while the work string assembly is in the wellbore;

automatically transmitting a firing confirmation signal from the firing confirmation tool along the work string to the surface above the wellbore based on the wellbore pressure.

4. The method of claim 1, wherein the step of transmitting the third electrical signal further comprises:

closing open electrical contacts together to complete an electrical circuit in a firing confirmation tool located along the work string assembly; and transmitting a firing confirmation signal from the firing confirmation tool through the work string assembly to the surface above the wellbore after the electrical contacts close, wherein the electrical contacts close after a portion of a primer cord of the one or more gun perforating assemblies located near the electrical contacts explodes.

5. The method of claim 1, wherein the step of transmitting the third electrical signal further comprises:

transmitting an electrical signal from a shock measuring device along the work string assembly to the surface above the wellbore; and automatically sending a fluid control signal from a processor above the wellbore surface to a fluid control device to control fluid flow from a reservoir surrounding the wellbore into an interior of the work string assembly.

6. The method of claim 1, wherein determining the depth of the perforating gun assembly further comprises:

measuring gamma ray radiation of a formation surrounding the wellbore with the depth correlation tool as the work string assembly is lowered into the wellbore;

transmitting an electrical signal related to the measured gamma ray radiation along the work string assembly to the surface above the wellbore; and comparing the measured gamma ray radiation to a reference gamma ray depth log of the wellbore to determine the position of the depth correlation tool within the wellbore.

7. The method of claim 6, further comprising:

verifying the position of the perforating gun assembly within the wellbore based on the position of the depth correlation tool within the wellbore and the location of the depth correlation tool along the work string assembly compared to the location of the perforating gun assembly; and, automatically initiating firing of the perforating gun assembly by a processor at the surface above the wellbore, wherein the processor transmits a firing signal along the work string assembly to initiate the firing when a desired position within the wellbore of the perforating gun assembly is verified relevant to a formation interval of the wellbore.

8. The method of claim 6, wherein initiating firing of the perforating gun assembly further comprises:

transmitting a firing command signal from the surface above the wellbore through the wired pipe to a firing tool located along the work string assembly;

receiving the firing command signal by the firing tool; confirming the firing command signal; and applying energy from the firing tool to a detonator of the perforating gun assembly to initiate firing of the perforating gun assembly.

9. The method of claim 1, wherein determining the depth of the perforating gun assembly further comprises:

measuring a magnetic anomaly of a casing joint with the depth correlation tool as the work string assembly is lowered into the wellbore, the magnetic anomaly corresponding to a signature for each casing joint of the casing;

transmitting an electrical signal related to the measured magnetic anomaly along the work string assembly to the surface above the wellbore; and comparing the measured magnetic anomaly to a reference collar locator depth log of each casing joint to determine the position of the depth correlation tool within the wellbore.

10. The method of claim 9, further comprising:

verifying the position of the perforating gun assembly within the wellbore based on the position of the depth correlation tool compared to the location of the perforating gun assembly; and automatically initiating firing of the perforating gun assembly by a processor at the surface above the wellbore, wherein the processor transmits a firing signal along the wired pipe to initiate the firing when a position of the perforating gun assemblies is verified relevant to a formation interval of the wellbore.

11. The method of claim 1, wherein initiating firing of the perforating gun assembly further comprises transmitting a firing command signal from the surface above the wellbore along the work string assembly to a firing tool located electrically coupled to the wired pipe or directly to the perforating gun assembly.

12. The method of claim 11, further comprising:

receiving the firing command signal by the firing tool; confirming the firing command signal; and applying energy from the firing tool to a detonator of the one or more perforating gun assemblies to initiate firing of the perforating gun assembly.

13. The method of claim 12, further comprising:

transmitting additional energy from the surface above the wellbore via the wired drill pipe to the detonator in combination with the energy applied from the firing tool.

14. The method of claim 11, wherein energy is transmitted from the surface above the wellbore directly to a detonator in the perforating gun assembly.

15. The method of claim 1, further comprising performing diagnostics of the perforating gun assembly and reporting information related to performance of the perforating gun assembly via signals transmitted along the wired drill pipe.

16. A method for monitoring a perforation process of a wellbore casing, comprising:

transmitting a depth data signal from a depth correlation tool via wired pipe string to a surface above the wellbore to position one or more perforating tools at a desired depth in the wellbore, wherein the wired pipe string comprising a string of pipes communicatively coupled at each pipe joint, and further wherein the depth correlation tool is within the wellbore and electrically coupled to the wired pipe string;

transmitting a firing command from the surface above the wellbore via the wired pipe string to initiate firing of one or more perforating tools positioned at the desired depth in the wellbore; and transmitting a flow control signal from the surface above the wellbore to a flow control device via the wired pipe string to control fluid flow from a reservoir surrounding the wellbore into an interior of the wired pipe string.

17. The method of claim 16, wherein the transmitting the flow control signal to the flow control device further comprises:

controlling fluid flow from a reservoir surrounding the wellbore into an interior of the wired pipe string wherein the flow control signal at least partially opens or closes the flow control device.

18. The method of claim 16, further comprising:

controlling fluid flow from an interior of the wired drill pipe to a wellbore annulus wherein the flow control signal at least partially opens or closes a ported sub positioned along the wired pipe string.

19. A system for perforating a wellbore casing, comprising:

a work string assembly having an interior, the work string assembly comprising a plurality of wired pipe communicatively coupled at each joint;

a gamma ray measurement and casing collar locator tool electrically coupled to the work string assembly;

one or more perforating gun assemblies electrically coupled to the work string assembly; and a flow control device electrically coupled to the work string assembly that controls fluid flow from a reservoir surrounding the wellbore into an interior of the work string assembly, the flow control device controllable from a surface above the wellbore via signals transmitted along the work string assembly, wherein the flow control devices comprise at least one of a ported sub and a well control valve.

* * * * *